United States Patent [19]

Goldowsky

[11] 4,359,872

[45] Nov. 23, 1982

[54] LOW TEMPERATURE REGENERATORS FOR CRYOGENIC COOLERS

[75] Inventor: Michael P. Goldowsky, Valhalla, N.Y.

[73] Assignee: North American Philips Corporation, New York, N.Y.

[21] Appl. No.: 302,279

[22] Filed: Sep. 15, 1981

[51] Int. Cl.[3] ..... F25B 9/02

[52] U.S. Cl. ..... 62/6; 165/10

[58] Field of Search ..... 62/6; 165/10

[56] References Cited

U.S. PATENT DOCUMENTS

| | | | |
|---|---|---|---|
| 3,304,999 | 12/1964 | Ward | 165/10 |
| 3,372,735 | 3/1968 | Meijer | 165/10 |
| 3,678,992 | 7/1972 | Daniels | 62/6 |
| 3,692,095 | 9/1972 | Fleming | 165/4 |
| 3,692,099 | 9/1972 | Nesbitt et al. | 165/10 |

OTHER PUBLICATIONS

"Regenerators in Cryogenic Refrigeration," Report AFFDL-TR-68-143, pp. 29-38, (AD844687) from Defense Technical Information Center (1969).

*Primary Examiner*—Ronald C. Capossela

*Attorney, Agent, or Firm*—Marc D. Schechter

[57] ABSTRACT

A regenerator for a closed thermodynamic cycle cryogenic cooler is made of a vessel containing helium. The helium may be contained in, for example, hollow glass spheres or hollow metal tubing. The pressure of the helium in the vessel and the size of the regenerator are chosen to assure that the mass of helium in the regenerator exceeds the mass of helium in the working gas which passes through the regenerator in the operation of the cooler. Closed thermodynamic cycles in which the helium-containing regenerators can be used include the Stirling cycle and the Vuilleumier cycle.

2 Claims, 3 Drawing Figures

LOW TEMPERATURE REGENERATORS FOR CRYOGENIC COOLERS

BACKGROUND OF THE INVENTION

The invention relates to regenerators for closed thermodynamic cycle coolers. More particularly, the invention relates to low temperature regenerators for cryogenic coolers.

In closed cycle coolers, a single quantity of working gas is repeatedly used in the thermodynamic cycle. In cryogenic coolers, the working gas chosen is usually helium. This choice is made because helium has the lowest liquefaction temperature of all known gases.

Examples of closed thermodynamic cycles are the Stirling cycle and the Vuilleumier cycle, both of which use regenerators. In these thermodynamic cycles, the regenerator functions as a near approximation to a heat reservoir. That is, the regenerator can reversibly store and release a given quantity of heat with minimal change in its temperature. The quantity of heat for which this holds true is a matter of design for each individual cooler application.

In the design of a regenerator, many different factors must be considered. For example, the rate of heat conduction of the regenerator material must be sufficient to assure that the regenerator stores and releases the desired quantity of heat in the time it takes for the working gas to pass through the regenerator. To achieve this requirement, it is generally preferred to choose a material with a high heat conductivity. At the same time, however, the thermal conductivity along the length of the regenerator, in the direction of working gas flow, should be low because there is usually a substantial temperature difference which must be maintained between the ends of the regenerator. In addition, the surface area of the material should be maximized to maximize contact with the working gas, and the sizes of individual particles of the material should be minimized to decrease the distance the heat must travel within the material.

On the other hand, another factor to be considered in designing a regenerator is the pressure drop in the working gas as it passes through the regenerator. The higher the pressure drop, the lower the efficiency of the cooler. However, when maximizing heat conduction by minimizing particle size, as discussed above, the result is an increase in the pressure drop in the working gas. Hence, a suitable compromise between these competing factors must be chosen.

Another important physical property to be considered in designing a regenerator is the heat capacity of the regenerator. The higher the heat capacity, the closer the regenerator approximates a heat reservoir. One way of increasing the heat capacity of a regenerator is to increase the mass of the regenerator. However, this method is typically limited by size, and weight, and dead volume constraints. Another method of increasing the heat capacity of a regenerator is to choose a material having as large a heat capacity as possible.

When designing a regenerator for a cryogenic cooler, special problems arise. For most materials the heat capacity drops as the temperature of the material drops. Accordingly, the heat capacity of the regenerator at the coldest working temperature of the regenerator is an important design consideration. Due to this known material limitation, closed cycle cryogenic refrigerators, such as those operating on the Stirling cycle, have in the past been limited in their ability to attain temperatures below about 10° K. The heat capacity of the regenerator material, usually lead, becomes so small at this temperature that the regenerator efficiency then plummets and the net cooling capacity of the cryogenic cooler quickly approaches zero.

In addition, the efficiency of regenerators at slightly higher temperatures (such as 20° K.) is characteristically low for the same reason; the heat capacity of the regenerator material is very small even at these temperatures. As a result, the overall cooling efficiency suffers.

SUMMARY OF THE INVENTION

It is an object of the invention to provide a regenerator which has a heat capacity greater than that of the working gas which passes through the regenerator at cryogenic operating temperatures.

It is a further object of the invention to provide a regenerator for a cryogenic cooler which has an improved heat capacity at temperatures below approximately 20° K.

According to the invention a regenerator for a closed thermodynamic cycle cooler comprises a vessel containing helium. Although the heat capacity of helium decreases as the temperature of the helium decreases, nevertheless the heat capacity of helium exceeds that of other materials at temperatures below 20° K.

Further, since helium is used both as the working gas and as the regenerator material, the relative heat capacity between the regenerator and the working gas remains approximately constant at all temperatures. This relative heat capacity is simply proportional to the ratio of the mass of helium in the regenerator divided by the mass of helium working gas which passes through the regenerator.

Thus, by providing a greater mass of helium in the regenerator then in the working gas, it is assured that the heat capacity of the regenerator exceeds that of the working gas at all operating temperatures.

In one embodiment of the invention, the vessel containing the helium is a multiplicity of hollow glass spheres. In another embodiment of the invention the vessel is one or more hollow metal tubes shaped to occupy a small volume. Preferably the tubes are woven into a mesh.

DESCRIPTION OF THE PREFERRED EMBODIMENTS

Figures 1, 2, 3:
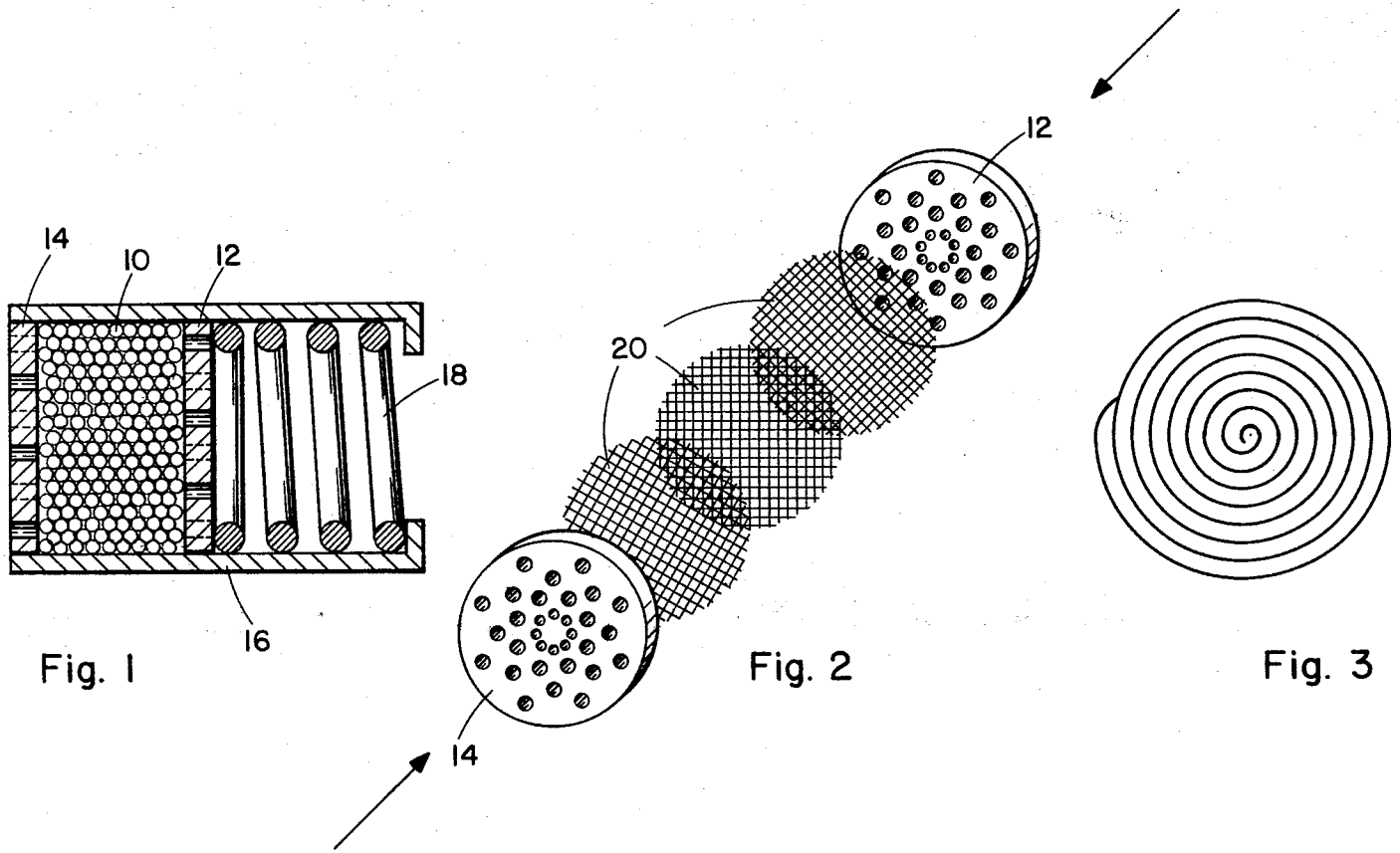
FIG. 1 is a cross-sectional view of a regenerator comprising helium-filled glass spheres according to the invention.
FIG. 2 is an exploded perspective view of a helium-filled, hollow metal tubing mesh regenerator according to the invention.
FIG. 3 is a plan view of a spiral mesh according to the invention.

Since helium is the preferred working gas in closed thermodynamic cycle cryogenic coolers, and since helium does not lose its heat capacity down to 4.2° K., helium is the preferred material for use in regenerators according to the present invention.

Further, since the efficiency of the cryogenic cooler increases as the heat capacity of the regenerator material increases (all other factors being equal), it is advantageous to provide as much helium as possible in the regenerator.

Since helium is used both in the regenerator and as the working gas, the heat capacity per unit mass of the entire regenerator is approximately the same as the heat capacity per unit mass of the working gas, at all temperatures. Accordingly, the ratio of the heat capacity of the regenerator to the heat capacity of the working gas, which determines whether the regenerator approximates a heat reservoir, is approximately equal to the ratio of the mass of the helium in the regenerator to the mass of the helium working gas which passes through the regenerator. (In actual coolers, the total amount of the working gas is greater than the amount of the working gas which passes through the regenerator.)

As a result, according to the invention it is desirable to maximize the ratio of the mass of helium in the regenerator to the mass of helium working gas which flows through the regenerator. This can conveniently be attained in the smallest volume by providing the helium under high pressure in a vessel.

Hollow Sphere Embodiment

In a preferred embodiment of the invention, the regenerator is made of many hollow glass spheres. Hollow glass spheres are commercially available from, for example, Minnesota Mining and Manufacturing Corporation, St. Paul, Minn. These spheres normally range in size from 20 to 130 microns with a wall thickness of 1 to 2 microns.

A method for producing small hollow glass spheres is disclosed in U.S. Pat. No. 4,257,799. A method for producing small hollow glass spheres filled with a gas is disclosed in U.S. Pat. No. 4,257,798. In these patents the spheres range in size from 50 to 500 microns in diameter with wall thicknesses ranging from 0.5 to 20 microns. As discussed below, in some applications of the inventive regenerator it may be preferable to utilize spheres manufactured according to one of these patents.

According to the invention, the microspheres used in the regenerator are the vessels which are filled with helium gas. The helium gas pressure chosen is not critical so long as the glass spheres do not burst. The important consideration is to provide more helium gas in the regenerator than the quantity of working gas, also helium, which repeatedly passes through the regenerator during the closed thermodynamic cycle. Calculations show that helium pressures of 10,000 pounds per square inch at 300° K. (room temperature) can be contained in the glass spheres without bursting. Such pressures should also provide a greater quantity of helium in the regenerator than the quantity of helium working gas which passes through the regenerator, for a reasonably sized regenerator.

In order to fill the glass spheres with helium, the spheres should be heated, in a high pressure helium atmosphere, to a temperature at which they become relatively permeable to helium. In order to minimize the risk of collapsing the glass spheres, the pressure of the helium atmosphere should be increased at a gradual rate. After equilibrum is reached the spheres should be cooled in the high pressure helium until they are no longer permeable to helium to any substantial extent.

For example, Dow-Corning type 1723 aluminum silicate glass will pass helium at a rate of $10^{-12}$ cubic centimeters (converted to standard temperature and pressure) per second, per square centimeter of surface area, per centimeter of Hg pressure difference across the glass wall, for one millimeter of wall thickness, at 300° C. For a sphere of this type of glass having a diameter of 100 microns and a wall thickness of 8 microns, it would take about four hours to charge the sphere with helium to a pressure of 5,000 pounds per square inch (measured at 300° C.) where the surrounding helium pressure is also 5000 pounds per square inch. By subsequently cooling the sphere to room temperature in the same helium atmosphere, the high pressure helium will become trapped inside of the sphere because the diffusion constant for this type of glass at room temperature is $10^{-16}$ (using the same units used for the diffusion constant at 300° C.). For a sphere charged with helium in this manner, it would require more than approximately 11 years for the pressure to drop from 5,000 pounds per square inch to 4,500 pounds per square inch at room temperature. This is because the diffusion constant at room temperature is less than that at 300° C. by a factor of 30,000. At cryogenic operating temperatures the diffusion constant is even smaller than at room temperature, and consequently a regenerator made up of such helium filled glass spheres will essentially last indefinitely.

After the helium-filled glass spheres are obtained and removed from the high pressure chamber, it is inevitable that some spheres will burst. Thus, it is desirable to separate the intact spheres from those that are broken. This can be accomplished by utilizing the density difference between broken glass and the intact spheres. Floatation, using a field gradient with a magnetic fluid, is but one well known practical method for separating materials of different density. Floatation in water is another method of separation.

After the intact spheres are separated from those that are broken, it may be desirable to separate a preferred size range of glass spheres for actual use in the regenerator. For example, it may be desirable to minimize the pressure drop of the working gas as it passes through the regenerator. The smaller the diameter of the glass spheres used in the regenerator, the larger the pressure drop will be. Accordingly, by utilizing the density differences between spheres of different sizes or by utilizing sieves with calibrated openings, the glass spheres can be segregated by size.

A further consideration in choosing the diameter of the glass spheres to be used in the regenerator is whether the helium-filled spheres will conduct heat at a sufficient speed to approximate a heat reservoir. The larger the diameters of the spheres, the longer it will take for heat to penetrate to the centers of the spheres. Each closed thermodynamic cycle cooler has its own heat penetration rate requirements and therefore the acceptable maximum size for the glass spheres will vary from one cooler application to another.

Referring to FIG. 1, in order to mount the helium-filled glass spheres 10 in a regenerator, it is preferred that the spheres 10 be mounted between two porous plates 12 and 14 in a cylindrical container 16. The plates should have pores whose size is less than the size of the smallest glass spheres used in the regenerator. (The size of the pores shown in FIG. 1 is exaggerated for clarity.) The pores allow helium working gas to pass through the regenerator without allowing the glass spheres to pass through. At least one plate 12 is spring-biased, by coil spring 18, to maintain the spheres 10 under compression between the two plates 12 and 14 and the walls of the container 16. The other porous plate 12 may simply be fastened to the walls of container 16.

While the mass of helium-filled glass spheres 10 need not have any self-supporting structure (since the spheres confined in cylindrical container 16 between plates 12 and 14), it is preferred that the spheres be bonded to one another in order to prevent wear due to abrasion. The spheres may be sintered into a rigid matrix, for example, by mixing a crystallizing solder glass with the spheres. The solder glass should have a low melting point as compared to that of the spheres. For example, with Dow-Corning solder glass type CV-102, by raising the temperature of the mixture of solder glass and glass spheres to 380° C. for five minutes, the solder glass will bond the spheres together. By using only a small amount of a solder glass having small particle sizes (for example, micron size particles) and by dispersing the solder glass uniformly through the spheres, the open spaces between the spheres will not become filled with solder glass and therefore the porosity of the rigid matrix can be preserved.

In operation, the working gas passes through the porous plates 12 and 14 and between the helium-filled glass spheres. Such a regenerator can be mounted in any closed thermodynamic cycle cooler as a replacement for known regenerators.

Hollow Tube Embodiment

In another preferred embodiment of the invention the regenerator is made of hollow metal tubing in the form of a wire mesh 20. (See, FIG. 2.) Proposed metals for the hollow tubing are copper, nickel, and stainless steel, though other metals should also work. As in the case of the glass spheres, the hollow tubing is the vessel which is filled with helium gas. The helium pressure should be chosen, as before, to assure that the mass of helium in the regenerator is greater than the mass of helium working gas which flows through the regenerator. By satisfying this requirement, the regenerator acts approximately like a heat reservoir with respect to the working gas.

To achieve a good compromise between the requirements that the regenerator has as large a surface area as possible, while minimizing the pressure drop of the working gas across the regenerator, and while maximizing the speed of thermal penetration into the tubing mesh, a proposed tubing could have a 0.004 inch outside diameter and a 0.002 inch inside diameter. Such a tubing is commercially available from, for example, Uniform Tubes, Incorporated, Collegeville, Pa. This tubing is seamless copper and has a tolerance of 0.0005 inches.

In a first step toward manufacturing a helium-filled tubing regenerator, long lengths of tubing are filled with helium gas and their ends are hermetically sealed. The tubing is then woven into screens on a weaving machine as is presently done with solid wire. The screening can then be punched-out on a press that utilizes a die. The die pinches the tubing and seals it by progressively thinning the tubing under a high force. The tubing cold welds and becomes hermetically sealed. The tubing also becomes disjoined, thereby separating it into a cut mesh of the geometry of the punch.

Alternatively, the helium tubes of the mesh may be ultrasonically welded closed in the desired geometry. After welding, the sealed mesh portion can be cut from the entire mesh.

Besides weaving the tubing into a mesh, other tubing configurations can also be used. For example a single length of tubing can be wound into a plane spiral configuration. (FIG. 3.) Sufficient space is left between the spirals to permit the helium working gas to flow between adjacent layers.

In order to construct a regenerator from the helium-filled mesh 20, the mesh 20 may be stacked and provided between the two porous plates 12 and 14 in cylindrical vessel 16 in the place of the glass spheres shown in FIG. 1. In this embodiment, however, the plates 12 and 14 can have much larger pores or openings than those used to contain the glass spheres, and the coil spring can be eliminated.

In either of the above or other embodiments of the invention, calculations have shown that the material which is used to make the hollow spheres, hollow tubes, or other pressure vessels in which the helium gas is contained is not critical, so long as the material can in fact contain the helium gas at the desired pressure. The heat conductivities of these materials is not a critical consideration because of the small diameters of the spheres and tubing. The small diameters result principally from the desire that the regenerator have a high surface area.

What is claimed is:

1. A regenerator, for a closed thermodynamic cycle cooler, comprising:

a cylindrical container having two open ends;

a first porous plate closing one end of the container;

a second porous plate, slidably mounted in the cylindrical container, closing the second end of the container;

a plurality of hollow glass spheres containing helium in the container between the porous plates; and means for compressing the glass spheres between the two porous plates.

2. A regenerator as claimed in claim 1, characterized in that the first porous plate is attached to the cylindrical container and the second porous plate is spring-biased toward the first plate.

* * * * *